US009205649B1

(12) United States Patent
Endo et al.

(10) Patent No.: US 9,205,649 B1
(45) Date of Patent: Dec. 8, 2015

(54) DISCHARGE ELEMENT SUBSTRATE, RECORDING HEAD, AND RECORDING APPARATUS

(71) Applicant: CANON KABUSHIKI KAISHA, Tokyo (JP)

(72) Inventors: Wataru Endo, Tokyo (JP); Masanobu Ohmura, Yokohama (JP); Kazunari Fujii, Tokyo (JP); Tatsuhito Goden, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/699,497

(22) Filed: Apr. 29, 2015

(30) Foreign Application Priority Data

May 14, 2014 (JP) ..... 2014-100784

(51) Int. Cl.
*B41J 2/14* (2006.01)
*B41J 2/16* (2006.01)
*B41J 2/045* (2006.01)

(52) U.S. Cl.
CPC ..... *B41J 2/14* (2013.01); *B41J 2/04523* (2013.01); *B41J 2/14072* (2013.01); *B41J 2002/14491* (2013.01)

(58) Field of Classification Search
CPC .... B41J 2/04541; B41J 2/0458; B41J 2/0455; B41J 2/04588; B41J 2/04543; B41J 2/04523; B41J 2/14072; B41J 2/14; B41J 2002/14491
See application file for complete search history.

(56) References Cited

U.S. PATENT DOCUMENTS

| | | | | |
|---|---|---|---|---|
| 6,890,048 | B2 | 5/2005 | Hirayama | |
| 7,044,572 | B2 | 5/2006 | Hirayama | |
| 8,226,190 | B2 | 7/2012 | Hirayama et al. | |
| 2005/0264608 | A1 * | 12/2005 | Hirayama | 347/54 |

FOREIGN PATENT DOCUMENTS

| | | | |
|---|---|---|---|
| JP | 2004-050742 | A | 2/2004 |
| JP | 2010-155452 | A | 7/2010 |

* cited by examiner

*Primary Examiner* — Juanita D Jackson
(74) *Attorney, Agent, or Firm* — Fitzpatrick, Cella, Harper & Scinto

(57) ABSTRACT

A substrate includes first and second power supply lines, and units. Each unit includes common transistor, discharge elements and individual transistors. One of source and drain of the common transistor is connected to the first power supply line, first nodes of the discharge elements are connected to other of the source and drain, one of source and drain of each individual transistor is connected to a second node of the discharge element, the other is connected to the second power supply line. Channel of the common transistor is wider than those of the individual transistors. Arrangement direction of the units and arrangement direction of the discharge elements are first direction, the first and second power supply lines extend in the first direction, and the second power supply line is wider than that of the first power supply line.

8 Claims, 4 Drawing Sheets

DISCHARGE ELEMENT SUBSTRATE, RECORDING HEAD, AND RECORDING APPARATUS

BACKGROUND OF THE INVENTION

1. Field of the Invention

The present invention relates to a discharge element substrate, a recording head, and a recording apparatus.

2. Description of the Related Art

With an inkjet recording head, ink is discharged from a discharge opening using energy emitted from a discharge element. Japanese Patent Laid-Open No. 2010-155452 discloses a configuration in which transistors are respectively arranged between the discharge element and a first power supply line, and between the discharge element and a second power supply line. Accordingly, the voltage applied to the discharge element is less likely to be influenced by voltage fluctuation of the first power supply line and voltage fluctuation of the second power supply line.

With a configuration in which two transistors are arranged for each discharge element as in Japanese Patent Laid-Open No. 2010-155452, the transistor size is increased in order to raise the driving capability, thus leading to upsizing of the substrate.

SUMMARY OF THE INVENTION

The present invention provides a technique advantageous to improving the capability to drive discharge elements, and downsizing the discharge element substrate.

One of aspects of the present invention provides a discharge element substrate comprising a first power supply line, a second power supply line, and a plurality of discharge element units, wherein each of the plurality of discharge element units includes a common transistor, a plurality of discharge elements, and a plurality of individual transistors, in each of the plurality of discharge element units, one of a source and drain of the common transistor is connected to the first power supply line, first nodes of the plurality of discharge elements are connected to other of the source and drain of the common transistor, one of a source and drain of each of the plurality of individual transistors is connected to a second node of a corresponding discharge element of the plurality of discharge elements, other of the source and drain of each of the plurality of individual transistors is connected to the second power supply line in common, and, a channel width of the common transistor is greater than a channel width of each of the plurality of individual transistors, an arrangement direction of the plurality of discharge element units and an arrangement direction of the plurality of discharge elements in each of the discharge element units are a first direction, the first power supply line and the second power supply line extend in the first direction, and a width of the second power supply line when viewed in the first direction is greater than a width of the first power supply line when viewed in the first direction.

Further features of the present invention will become apparent from the following description of exemplary embodiments with reference to the attached drawings.

BRIEF DESCRIPTION OF THE DRAWINGS

FIG. 2 is a diagram showing an example of an arrangement of discharge elements, common transistors, individual transistors, and the like.

FIG. 3 is a diagram showing an example of an arrangement of discharge elements, common transistors, individual transistors, and the like.

DESCRIPTION OF THE EMBODIMENTS

Hereinafter, the present invention will be described by way of exemplary embodiments with reference to the accompanying drawings.

Figure 1:
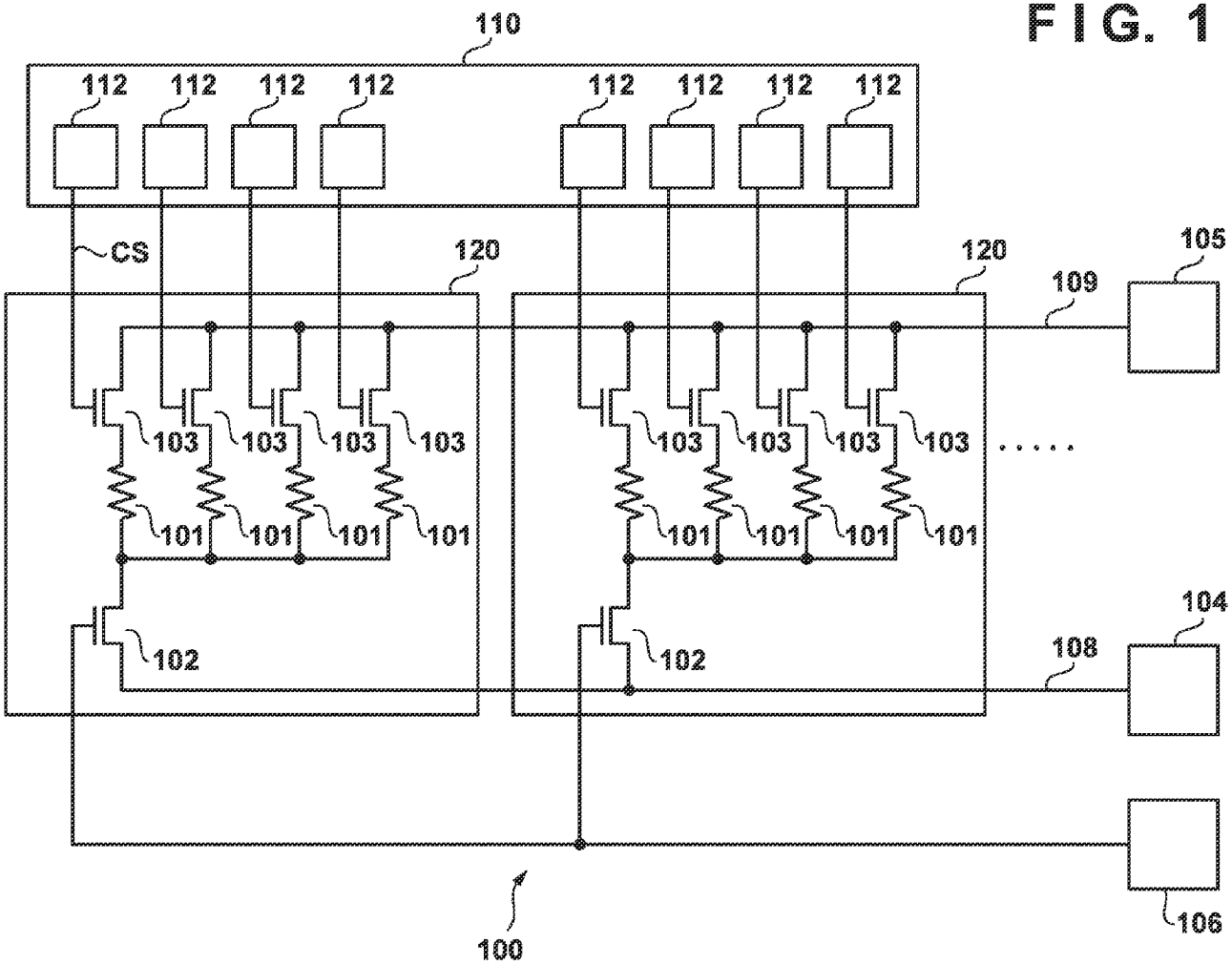
FIG. 1 is a diagram showing a circuit configuration of a discharge element substrate according to an exemplary embodiment of the present invention.

FIG. 1 shows the circuit configuration of a discharge element substrate 100 according to an exemplary embodiment of the present invention. The discharge element substrate 100 is integrated in a recording head that has a discharge opening for discharging ink. The discharge element substrate 100 causes ink to be discharged from the discharge opening using energy emitted from discharge elements 101. In this example, the discharge element 101 is a heater (resistance element), and the energy emitted from the discharge element 101 is thermal energy, but another type of element can be applied as the discharge element 101.

The discharge element substrate 100 includes a first power supply line 108 that is connected to a first power supply terminal (first power supply pad) 104, a second power supply line 109 that is connected to a second power supply terminal (second power supply pad) 105, and multiple discharge element units 120. Each discharge element unit 120 can include a common transistor 102, multiple discharge elements 101, and multiple individual transistors 103. One of the source and drain of the common transistor 102 is connected to the first power supply line 108. First nodes of the discharge elements 101 are connected to the other of the source and drain of the common transistor 102. One of the source and drain of each of the individual transistors 103 is connected to the second node of a corresponding discharge element 101 out of the discharge elements 101. Out of the source and drain of each of the individual transistors 103, the other is connected to the second power supply line 109 in common. The gate of the common transistor 102 receives a bias voltage via a third power supply terminal (third power supply pad) 106.

The discharge element substrate 100 can further include a control unit 110 that generates control signals CS that are supplied to the gates of the individual transistors 103. The control unit 110 has multiple control circuits 112, and each control circuit 112 corresponds to one individual transistor 103. The control circuits 112 supply the control signals CS to the gates of the corresponding individual transistors 103. The control circuits 112 that constitute the control unit 110 generate the control signals CS such that current does not flow to multiple discharge elements 101 in each discharge element unit 120 at the same time. Specifically, the control circuits 112 that constitute the control unit 110 generate the control signals CS such that the individual transistors 103 in each discharge element unit 120 are switched on in mutually different periods.

In one example, the common transistor 102 is constituted by a PMOS transistor, the individual transistors 103 are constituted by NMOS transistors, a ground voltage GNDH is supplied to the first power supply line 108, and a positive voltage VH is supplied to the second power supply line 109. In another example, the common transistor 102 is constituted by an NMOS transistor, the individual transistors 103 are constituted by PMOS transistors, a positive potential VH is supplied to the first power supply line 108, and a ground potential GNDH is supplied to the second power supply line 109. In yet another example, the common transistor 102 and the individual transistors 103 are constituted by bipolar transistors, and in this case, the gates, drains, and sources are respectively replaced with bases, emitters, and collectors.

Figure 2:
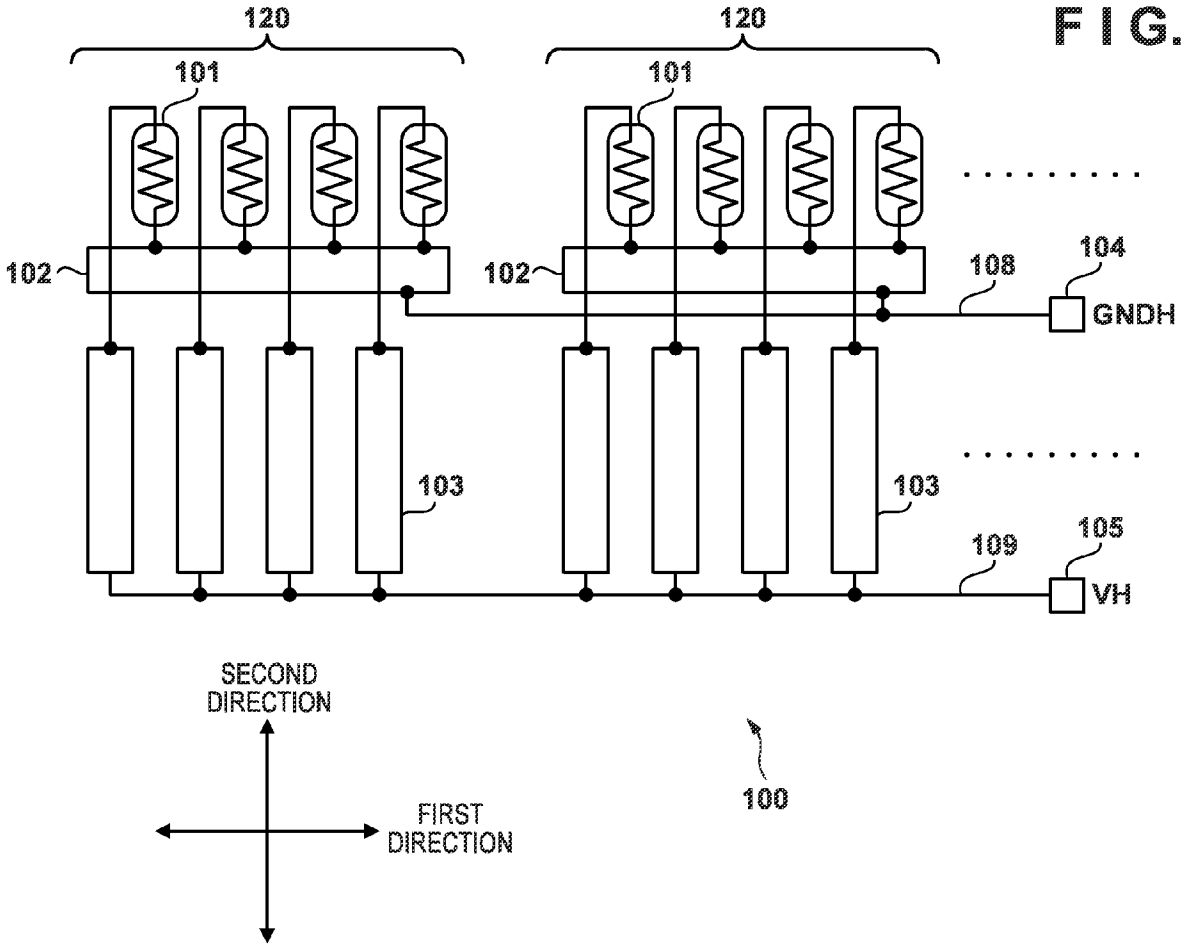

FIG. 2 shows an example of the arrangement of the discharge elements 101, the common transistors 102, the individual transistors 103, and the like that constitute the discharge element substrate 100. For the sake of convenience in the description, a first direction and a second direction are defined as directions that are orthogonal to each other. The arrangement direction of the discharge element units 120 and the arrangement direction of the discharge elements 101 in each discharge element unit 120 are the first direction. With respect to the region occupied by each common transistor 102, the length of the region in the first direction is greater than the length of the region in the second direction. With respect to the region occupied by each individual transistor 103, the length of the region in the second direction is greater than the length of the region in the first direction.

In the example shown in FIG. 2, the common transistor 102 is arranged between the discharge elements 101 and the individual transistors 103 in the second direction, but this is merely one example, and these elements may be arranged in another sequence. Note that an ink supply opening (not shown) for supplying ink needs to be arranged in the vicinity of the discharge elements 101, and therefore it is preferable that the common transistor 102 and the individual transistors 103 are both arranged on one side of the discharge element 101.

Next, a preferable design for the common transistor 102 and the individual transistors 103 will be described. It is preferable that the channel width of the common transistor 102 is greater than the channel widths of each of the individual transistors 103. The reason for this will be described below. The one common transistor 102 is provided in common for the discharge elements 101 of each discharge element unit 120. Accordingly, even if the channel width of the common transistor 102 is increased, this has little influence on an increase in the size of the discharge element substrate 100. Specifically, letting X be the increase in the channel width of the common transistor 102, and n be the number of discharge elements 101 in one discharge element unit 120, an increase in the size of the discharge element substrate 100 per discharge element 101 is suppressed to X/n. In this case, the driving capability of the common transistor 102 with respect to the discharge elements 101 can be increased by increasing the channel width of the common transistor 102.

In each discharge element unit 120, the individual transistors 103 are switched on in mutually different periods. In other words, in each discharge element unit 120, when one individual transistor 103 is on, the other individual transistors 103 are off. The value of the current flowing in the individual transistor 103 that is switched on is a value obtained by subtracting the value (sum) of the current flowing in the individual transistors 103 that are switched off from the value of the current that flows in the common transistor 102. In other words, the value of the current flowing in the individual transistor 103 that is switched on can be increased by reducing the value of the current flowing in the individual transistors 103 that are switched off. The reduction of the value of the current flowing in the individual transistors 103 that are switched off can be realized by increasing the resistance value of the individual transistors 103 that are switched off (e.g., reducing the channel width of these individual transistors 103). Note that in general, the on resistance value and off resistance value of a transistor are proportional to the channel width of that transistor. In this case, if the channel width of an individual transistor 103 is reduced, the on resistance value of the individual transistor 103 also increases, but since the on resistance value is sufficiently small, it is possible to ignore the reduction in the driving capability with respect to the individual transistors 103 caused by reducing the channel width.

As described above, it is advantageous to increase the channel width of the common transistor 102 and decrease the channel width of the individual transistors 103. As one guide, it can be said to be preferable to set the channel width of the common transistor 102 higher than the channel width of each of the individual transistors 103. This configuration is advantageous to improving the capability to drive the discharge elements 101, and downsizing the discharge element substrate 100.

The capability to drive the discharge elements 101 (driving capability) can be expressed by the value of current that can flow in the discharge elements 101. The common transistor 102 and the individual transistors 103 operate in a saturated region. The value of current that can flow in the discharge elements 101 is the value of the drain current of the common transistor 102 and the individual transistors 103 in the saturated region. A value $I_{Di}$ of the drain current of the common transistor 102 in the saturated region and a value $I_{Dc}$ of the drain current of the individual transistors 103 in the saturated region are expressed by Equations 1 below. In these equations, $\beta_c$ represents the gain coefficient of the common transistor 102, and $\beta_i$ represents the gain coefficient of the individual transistors 103. Also, $V_{GSc}$ represents the gate-to-source voltage of the common transistor 102, and $V_{GSi}$ represents the gate-to-source voltage of the individual transistors 103. Also, $V_{THc}$ represents the threshold voltage of the common transistor 102, and $V_{THi}$ represents the threshold voltage of the individual transistors 103.

$$I_{Dc}=(\beta_c/2)\cdot(V_{GSc}-V_{THc})^2$$

$$I_{Di}=(\beta_i/2)\cdot(V_{GSi}-V_{THi})^2 \quad \text{(Eq. 1)}$$

As shown by Equations 1, the driving capability with respect to the discharge elements 101, that is to say the drain currents $I_{Dc}$ and $I_{Di}$, can be increased by increasing the gain coefficients $\beta_c$ and $\beta_i$. The gain coefficients $\beta_c$ and $\beta_i$ are expressed by Equations 2 below. In these equations, $W_c$ represents the channel width of the common transistor 102, $W_i$ represents the channel width of the individual transistors 103, $L_c$ represents the channel length of the common transistor 102, and $L_i$ represents the channel length of the individual transistors 103. Also, $\mu_c$ represents the carrier mobility in the common transistor 102 and $\mu_i$ represents the carrier mobility in the individual transistors 103. Also, $C_{OX}$ represents the capacitor per unit area of the gate of the common transistor 102 and the individual transistors 103.

$$\beta_c=(W_c/L_c)\cdot\mu_c\cdot C_{OX}$$

$$\beta_i=(W_i/L_i)\cdot\mu_i\cdot C_{OX} \quad \text{(Eq. 2)}$$

Figure 5:
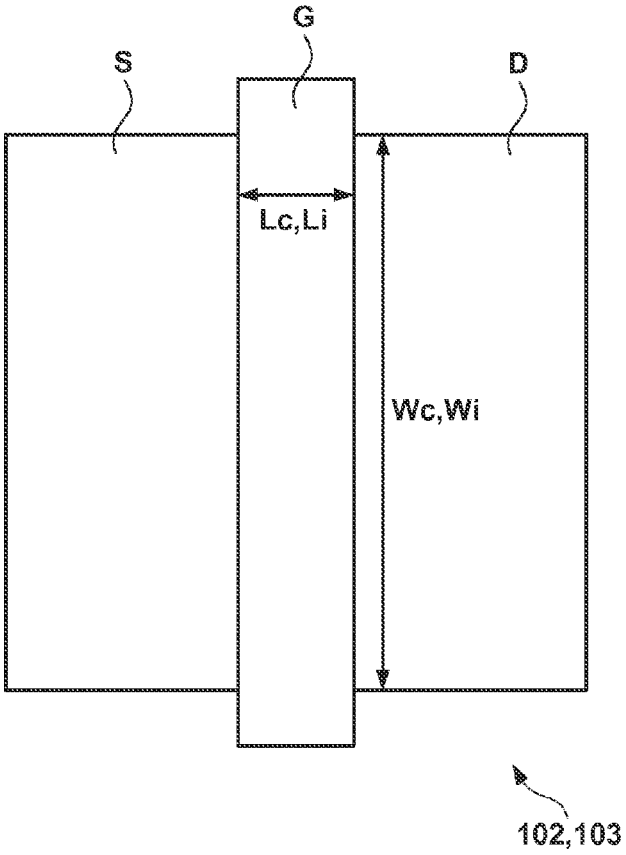
FIG. 5 is a diagram showing definitions of a channel width $W_c$ and a channel length $L_c$ of a common transistor, as well as a channel width $W_i$ and a channel length $L_i$ of an individual transistor.

As described above, as one guide, it is preferable that the channel width $W_c$ of the common transistor 102 is greater than the channel width $W_i$ of each of the individual transistors 103. Alternatively, as another guide, the relationship $W_c/L_c > W_i/L_i$ or $\beta_c > \beta_i$ may be applied. In other words, satisfying $W_c/L_c > W_i/L_i$ or $\beta_c > \beta_i$ is also advantageous to improving the capability to drive the discharge elements 101, and downsizing the discharge element substrate 100. FIG. 5 shows definitions of the channel width $W_c$ and the channel length $L_c$ of the common transistor 102, and the channel width $W_i$ and the channel length $L_i$ of the individual transistors 103. In FIG. 5, G indicates a gate, S indicates a source, and D indicates a drain.

In one example, the common transistor 102 can be arranged such that its channel width direction (the direction extending along the channel width) matches the first direction, and the individual transistors 103 can be arranged such that their channel width direction (direction extending along the channel width) matches the second direction. In other words, the common transistor 102 can be arranged such that the direction of current flowing therein matches the second direction, and the individual transistors 103 can be arranged such that the direction of current flowing therein matches the first direction.

Figure 3:
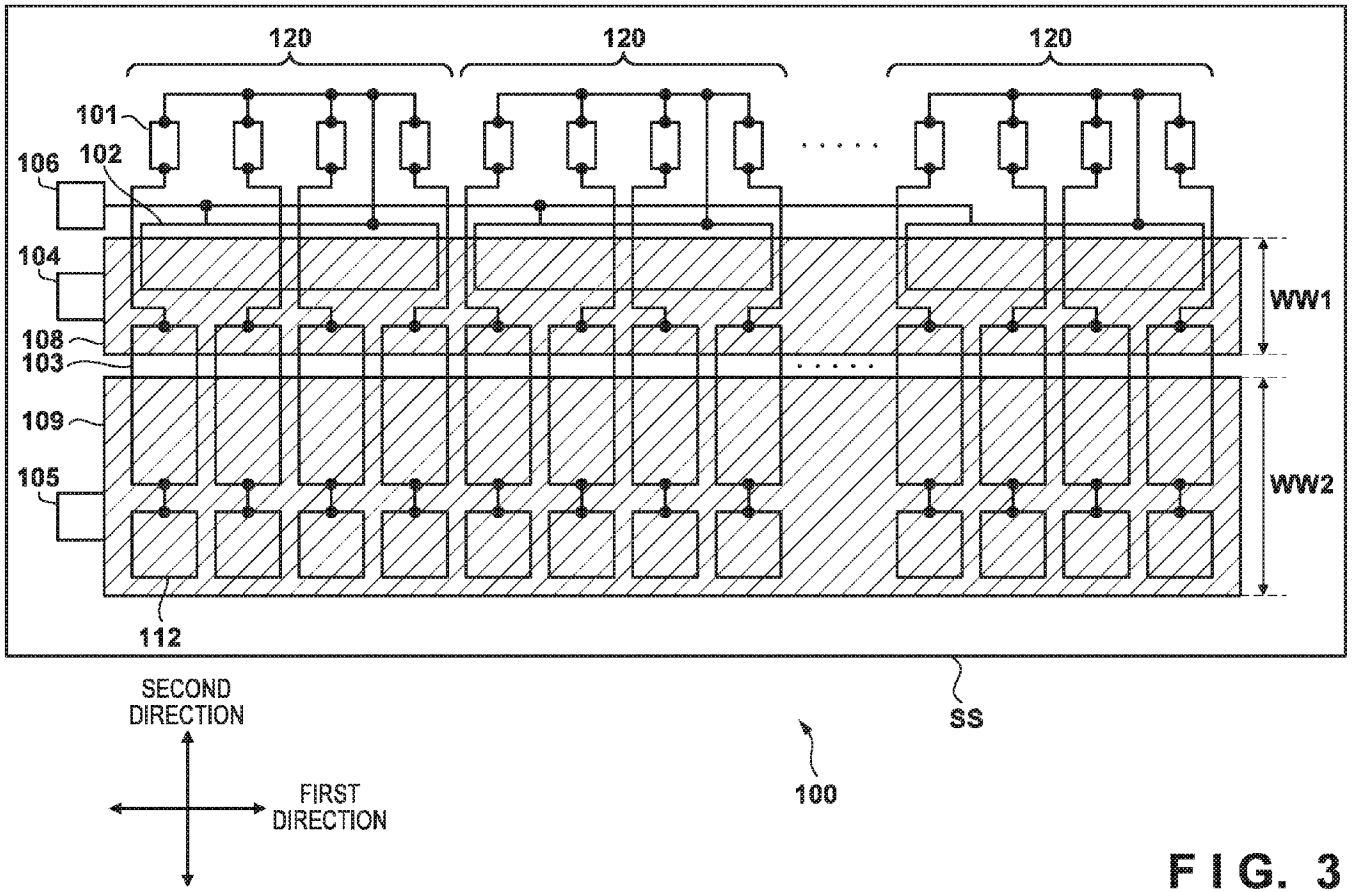

FIG. 3 shows an example of a more specific configuration of the configuration shown in FIG. 2. The discharge elements 101, the common transistors 102, the individual transistors 103, and the control circuits 112 are formed on a semiconductor substrate SS. The individual transistors 103 are arranged between the discharge elements 101 and the control circuits 112, and the common transistors 102 are arranged between the discharge elements 101 and the individual transistors 103.

The first power supply line 108 connects the first power supply terminal 104 to the drain of the common transistor 102 in each of the discharge element units 120. The second power supply line 109 connects the second power supply terminal 105 to the drains of the individual transistors 103 in each discharge element unit 120. The discharge elements 101 can be connected to the common transistor 102 and the individual transistors 103 by connection lines arranged in a first interconnect layer, for example. The first power supply line 108 and the second power supply line 109 can be arranged in a second interconnect layer arranged above the first interconnect layer. The first power supply terminal 104 can be arranged in the vicinity of the end portion of the first power supply line 108 on the first direction side, and the second power supply terminal 105 can be arranged in the vicinity of the end portion of the second power supply line 109 on the first direction side.

In the example shown in FIG. 3, the arrangement direction of the discharge element units 120 and the arrangement direction of the discharge elements 101 in each of the discharge element units 120 are the first direction, and the first power supply line 108 and the second power supply line 109 extend in the first direction. Also, a width WW2 of the second power supply line 109 is greater than a width WW1 of the first power supply line 108 when viewed in the first direction. The width WW2 of the second power supply line 109 when viewed in the first direction is defined as a distance between two edges of the second power supply line 109 arranged in a second direction which is orthogonal to the first direction. In other words, the width WW2 of the second power supply line 109 when viewed in the first direction is defined as a length thereof along the second direction. The width WW2 of the first power supply line 108 when viewed in the first direction is defined as a distance between two edges of the first power supply line 108 arranged in the second direction which is orthogonal to the first direction. In other words, the width WW1 of the first power supply line 108 when viewed in the first direction is defined as a length thereof along the second direction. According to this configuration, voltage drop in the second power supply line 108 can be suppressed, thus making it possible to reduce the voltage applied to the second power supply line 108, and making it possible to reduce the voltage for driving the control circuits 112.

In the example shown in FIG. 3, the first power supply line 108 extends over at least a portion of the region in which the common transistor 102 is arranged, and over a portion of the region in which the individual transistors 103 are arranged. Also, the second power supply line 109 extends over a portion of the region in which the individual transistors 103 are arranged, and does not extend over the region in which the common transistor 102 is arranged. According to this configuration, voltage drop in the first power supply line 108 can be suppressed to a greater extent than with a configuration in which the first power supply line 108 extends over only the region in which the common transistor 102 is arranged. In this case, in each discharge element substrate 100, the second direction width of the region in which the row of common transistors 102 is arranged is less than the second direction width of the region in which the row of individual transistors 103 is arranged. Accordingly, with a configuration in which the first power supply line 108 extends over only the region in which the common transistor 102 is arranged, the width of the first power supply line 108 in the second direction decreases, and voltage drop in the first power supply line 108 tends to increase.

Figure 4:
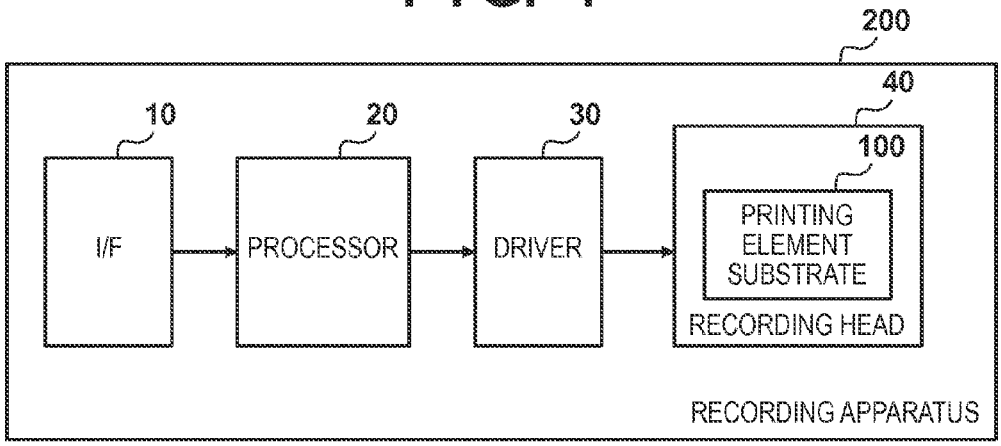
FIG. 4 is a diagram showing a configuration of a recording apparatus according to an exemplary embodiment of the present invention.

FIG. 4 shows the configuration of a recording apparatus 200 according to an exemplary embodiment of the present invention. The recording apparatus 200 can include an interface 10, a processor 20, a driver 30, and a recording head 40, for example. The interface 10 receives information from an information processing apparatus such as a computer. The processor 20 processes the information that was received from the information processing apparatus via the interface 10, and generates recording data. The driver 30 drives the recording head 40 based on the recording data that was generated by the processor 20. The recording head 40 includes the above-described discharge element substrate 100, and records information such as an image to a printing medium by discharging ink from a discharge opening using energy emitted from the discharge elements 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-100784, filed May 14, 2014, which is hereby incorporated by reference herein in its entirety.

What is claimed is:

1. A discharge element substrate comprising a first power supply line, a second power supply line, and a plurality of discharge element units, wherein each of the plurality of discharge element units includes a common transistor, a plurality of discharge elements, and a plurality of individual transistors, in each of the plurality of discharge element units, one of a source and drain of the common transistor is connected to the first power supply line, first nodes of the plurality of discharge elements are connected to other of the source and drain of the common transistor, one of a source and drain of each of the plurality of individual transistors is connected to a second node of a corresponding discharge element of the plurality of discharge elements, other of the source and drain of each of the plurality of individual transistors is connected to the second power supply line in common, and, a channel width of the common transistor is greater than a channel width of each of the plurality of individual transistors, an arrangement direction of the plurality of discharge element units and an arrangement direction of the plurality of discharge elements in each of the discharge element units are a first direction, the first power supply line and the second power supply line extend in the first direction, and a width of the second power supply line when viewed in the first direction is greater than a width of the first power supply line when viewed in the first direction.

2. The discharge element substrate according to claim 1, further comprising a control unit that generates a plurality of control signals that are to be supplied to gates of the plurality of individual transistors, wherein the control unit generates the plurality of control signals such that in each of the discharge element units, the plurality of individual transistors are respectively switched on in mutually different periods.

3. The discharge element substrate according to claim 1, wherein the common transistor and the plurality of individual transistors operate in a saturated region.

4. The discharge element substrate according to claim 1, wherein the first power supply line extends over at least a portion of a region in which the common transistor is arranged and over a portion of a region in which the plurality of individual transistors are arranged, and the second power supply line extends over a portion of the region in which the plurality of individual transistors are arranged, and does not extend over the region in which the common transistor is arranged.

5. The discharge element substrate according to claim 1, further comprising a first power supply terminal that is connected to the first power supply line, and a second power supply terminal that is connected to the second power supply line, wherein the first power supply terminal is arranged in a vicinity of an end portion of the first power supply line on the first direction side, and the second power supply terminal is arranged in a vicinity of an end portion of the second power supply line on the first direction side.

6. The discharge element substrate according to claim 1, wherein letting $W_c$ be a channel width of the common transistor, $L_c$ be a channel length of the common transistor, $W_i$ be a channel width of each of the plurality of individual transistors, and $L_i$ be a channel length of each of the plurality of individual transistors, the following is satisfied:

$$W_c/L_c > W_i/L_i.$$

7. A recording head comprising the discharge element substrate according to claim 1.

8. A recording apparatus that comprises the recording head according to claim 7, and performs recording on a medium using the recording head.

* * * * *